United States Patent [19]

Lindblad

[11] Patent Number: 4,474,643

[45] Date of Patent: Oct. 2, 1984

[54] METHOD FOR CONTROLLING THE MOISTURE CONTENT OF A FIBER WEB AND APPARATUS FOR ACCOMPLISHING THE METHOD AND A PAPER MAKING MACHINE FOR ACCOMPLISHING THE METHOD AND A PAPER MAKING MACHINE WITH AN APPARATUS FOR ACCOMPLISHING THE METHOD

[75] Inventor: Rolf W. Lindblad, Helsinki, Finland

[73] Assignee: Albany International Corp., Menands, N.Y.

[21] Appl. No.: 74,731

[22] Filed: Sep. 12, 1979

[30] Foreign Application Priority Data

Sep. 25, 1978 [SE] Sweden ..... 7810014

[51] Int. Cl.[3] ..... D21F 11/00

[52] U.S. Cl. ..... 162/198; 162/207; 34/50; 34/54; 34/111; 34/116; 34/155

[58] Field of Search ..... 162/204, 207, DIG. 11, 162/198; 34/116, 23, 111, 50, 155, 54

[56] References Cited

U.S. PATENT DOCUMENTS

| | | | |
|---|---|---|---|
| 2,020,056 | 11/1935 | Gibbs | 34/116 |
| 2,661,669 | 12/1953 | Friedrich | 162/207 |
| 2,951,007 | 8/1960 | Lippke | 162/198 |
| 3,388,479 | 6/1968 | Gardner | 34/116 |
| 3,859,163 | 1/1975 | Haythornthwaite | 162/198 |

*Primary Examiner*—Peter Chin

*Attorney, Agent, or Firm*—Kane, Dalsimer, Kane, Sullivan & Kurucz

[57] ABSTRACT

A method is provided for controlling the moisture content of a paper web during its movement through the drying section of a paper making machine.

According to the present invention it is possible to control or equalize the moisture profile of a fiber web, e.g. the paper web in a paper making machine, during its movement through the drying section of a paper making machine, so that the finished paper web will be provided with a desired moisture level and if desired a moisture profile as uniform as possible, wherein the paper web in the drying section of the machine being moved to contact with a means, the parts of which contacting the part of a paper web, where moisture shall be increased or further moisture loss shall be prevented, being damped.

2 Claims, 6 Drawing Figures

METHOD FOR CONTROLLING THE MOISTURE CONTENT OF A FIBER WEB AND APPARATUS FOR ACCOMPLISHING THE METHOD AND A PAPER MAKING MACHINE FOR ACCOMPLISHING THE METHOD AND A PAPER MAKING MACHINE WITH AN APPARATUS FOR ACCOMPLISHING THE METHOD

BACKGROUND OF THE INVENTION

A method is provided for controlling the moisture content of a fiber web and apparatus for accomplishing the method and a paper making machine for accomplishing the method and a paper making machine with an apparatus for accomplishing the method.

The present invention relates to a method for controlling the moisture content, e.g. moisture content, moisture ratio, moisture level etc, of a fiber web during its movement through a machine section, e.g. the drying section, of a paper making machine, an apparatus for accomplishing the method, a paper making machine for accomplishing the method and a paper making machine with an apparatus for accomplishing the method.

TECHNICAL STAND POINT

A fiber web, e.g. a paper web, is prepared by feeding in water uniformly distributed fibers on/or between forming cloths. Subsequently the main part of the water is removed by self draining and suction. From the forming section of the paper making machine there is received a continuous fiber sheet or a continous fiber web with relatively high moisture content to be reduced by pressing and/or drying in a pressing or drying section after the forming section of the paper making machine. As much water as possible should be removed by pressing and the rest of the excess moisture is removed by drying of the fiber web on heated cylinders. The weight and moisture irregularity of the fiber web before drying, irregularities in the heat transfer from the cylinders and variations in the ventilation of the machine provides among other things that the drying is not uniform in the cross-direction of the web but is generally less in the middle and higher at the edges. Such an over-drying of the edges on especially sensible paper qualities, e.g. printing paper, results in deteriorated paper quality and eventually also in increased waste because the edges had to be cut and rejected, which may lead to a production loss of several percent. The problem is well known for the experts of this technical field and many measures have been taken to equalize the drying and the moisture content such as the moisture profile of the dried fiber web or paper web.

One way is to use an air permeable fabric a so-called drying fabric, with varying permeability in the cross-direction, which is provided by variable density of the longitudinal threads of the fabric or by coating on the edges of the fabric. Another way is to vary the pressure of the fabric against the web or drying cylinder for providing different drying degrees in different sections of the web. In both ways the moisture profile is controlled by controlling of the drying speed and both these ways or solutions have disadvantages because the moisture controls both to its degree and position must be planned and determined already before the manufacturing of the cloth and therefore cannot be adjusted in relation to momentary different situations in the paper making machine.

Yet a way to provide uniform terminal moisture is to pass the fiber web through a moisture neutral atmosphere, in which the web is momentary or locally exposed to a moisture atmosphere different in relation to the present moisture of the web. Such an arrangement does demand a room or a chamber containing the desired atmosphere and such a thing is very difficult to provide in direct connection with the manufacturing of paper in a paper making machine.

A further way is to transfer moisture direct to certain parts of the cross section of the fiber web or paper web. Such a direct transfer of moisture can be made by water either as gas or liquid (damp). By liquid it is rather difficult to provide an equalization of the moisture profile of the web satisfactory and it might provide an irregular moisture distribution creating spots of moisture in the finished paper. Moisture transfer by direct spraying of damp might provide difficulties because the damp has a low specific weight and therefore difficulties in penetrating the air layer closest to the surface of the sheet moving with a speed of up to one thousand meter per minute.

The problem to be solved is in a simple, fast and flexible way influence the moisture content, e.g. the moisture content, the moisture ratio, the moisture profile etc, of a fiber web in order to equalize the moisture profile across the web and to raise the moisture level either in the whole web or only the surface layer.

SUMMARY OF THE INVENTION

The technical problem is solved in accordance with the present invention in that the fiber web being moved to contact with at least one at least to certain part moisture containing means for transfering moisture from said part of the means to the fiber web. In an apparatus for accomplishing the method according to the present invention the technical problem is solved in that at least one means is at least to a certain part provided with moisture and is situated in the movement path of a fiber web to contact the fiber web and in that a cylinder is situated in the movement path, so that said means and the fiber web being pressed against the cylinder in order to at least partly transfer the moisture of the means to the fiber web. In a paper making machine the technical problem is solved in that an apparatus is arranged in the drying section of the machine or in that at least one moisture transmitter is placed close to a cloth in the drying section of the machine in order to transfer moisture to at least a part of the cloth to be forwarded to a fiber web moving through the drying section.

By the solution according to the present invention it is possible to continuously during the manufacturing control the moisture content of a fiber web or paper web. Further it is not only possible to equalize the moisture profile but also to control the level of the moisture with satisfying accuracy. According to the present invention it is also possible with a versatile use in that only small alterations in the present drying section have to be done or in that a special section for moisture control is arranged.

DETAILED DESCRIPTION OF THE INVENTION

The present invention will be described in the following in connection with the use in a paper making machine and in more detail the drying section of a paper making machine. Mostly the drying section of a paper making machine includes several groups of drying cylinders arranged in series after each other. The present invention can be arranged in one or more of the groups and will be described in connection with one group of drying cylinders shown on the drawings.

Figure 1:
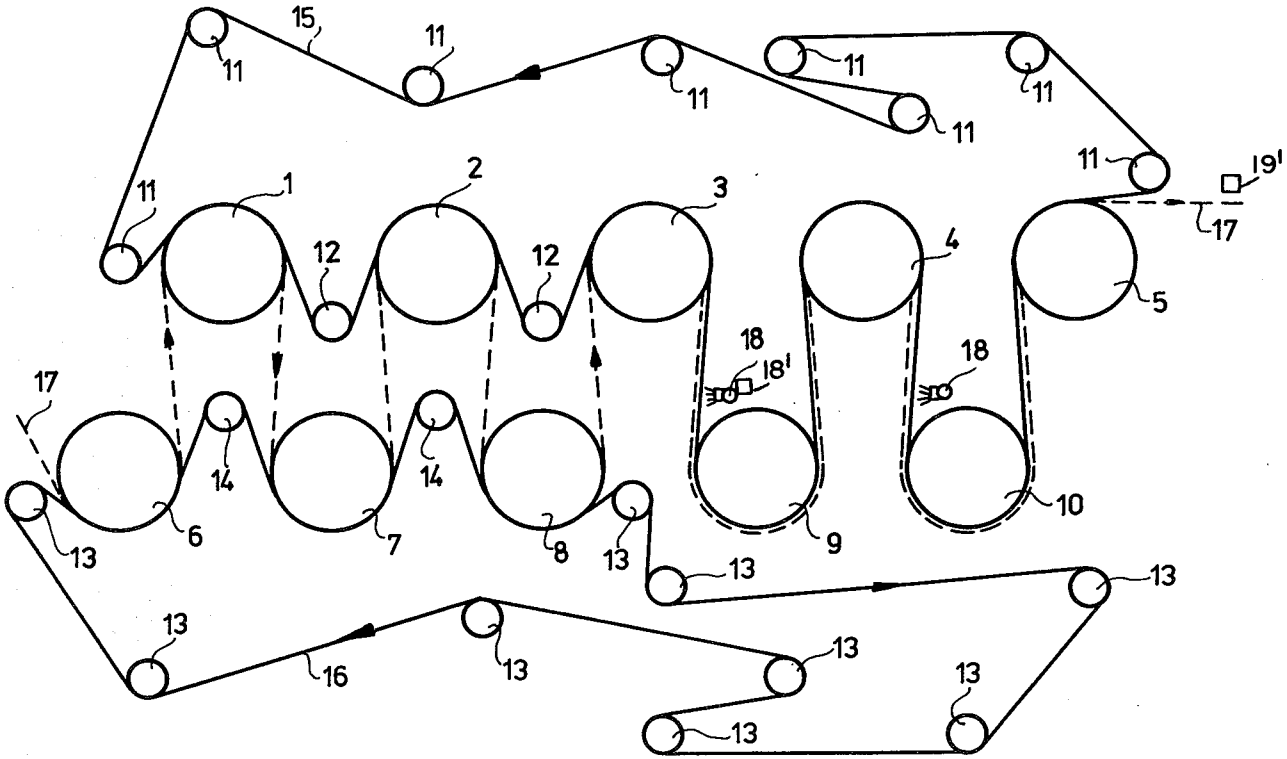
FIG. 1 is a schematic side view of a drying section with one embodiment of the present invention in a paper making machine.

The group of drying cylinders in FIG. 1 includes one upper line of drying cylinders 1, 2, 3, 4, and 5 and one lower line of drying cylinders 6, 7, 8, 9 and 10 and a number of felt turn rollers 11 and felt rollers 12 for the upper drying cylinders 1–5 and a number of felt turn rollers 13 and felt rollers 14 for the lower drying cylinders 6–10. A cloth 15 (solid line on the drawings) in form of a fabric or felt passes around the upper drying cylinders 1–5 and their felt turn rollers 11 and felt rollers 12 and the drying cylinders 9 and 10 in the lower line, while a cloth 16 (solid line on the drawings) in form of a fabric or felt passes around the drying cylinders 6–8 in the lower line and their felt turn rollers 13 and conducting rollers 14. It is possible to freely combine the cloths 15 and 16, so that both the cloths are fabric or felt or one is a fabric and the other is a felt. A fiber web 17 (broken line on the drawings) in form of a paper web is inserted between the cloth 16 and the drying cylinder 6 and passes in between the cloth 15 and the drying cylinder 1 and in the same way passed the drying cylinders 7, 2, 8 and 3, whereupon the cloth 16 in the lower line is diverted and the cloth 15 in the upper line leads the cylinder 3 together with the fiber web 17 passed the drying cylinders 9, 4, 10 and 5. From the last drying cylinder 5 a fiber web is taken out from the drying section, if the group of drying cylinders shown is the last group in the section or will be taken to a following group of drying cylinders if the end of the drying section has not been reached. One or several spraying nozzles 18 for dampening the cloth 15 are positioned between the drying cylinder 3 and the drying cylinder 9 and between the drying cylinder 4 and 10. The nozzles 18 between the last drying cylinders 4 and 10 can be removed or used instead of the nozzles 18 between the drying cylinders 3 and 9. It is even possible to use a spraying means inside the drying cylinders 9 and 10. (These modifications are possible in all embodiments, where it seems applicable.) The nozzles 18 dampen the whole cloth 15 or only chosen parts of the cloth 15 and when the cloth 15 together with the paper web 17 contacts the drying cylinder 9, shown more in detail in FIG. 2, the moisture of the damped parts of the cloth 15 will evaporate and penetrate in direction to the paper web 17. Because the paper web 17 is drier and colder than the cloth 15, the damp steam will condense and increase the moisture content in the parts of the fiber web opposite the damped parts of the cloth 15. The result will be the same at the drying cylinder 10.

The transfer of dampness or moisture from the cloth 15 will be improved by the centrifugal force. The transfer of moisture or damp can be controlled by the choice of cloth.

Figure 2:
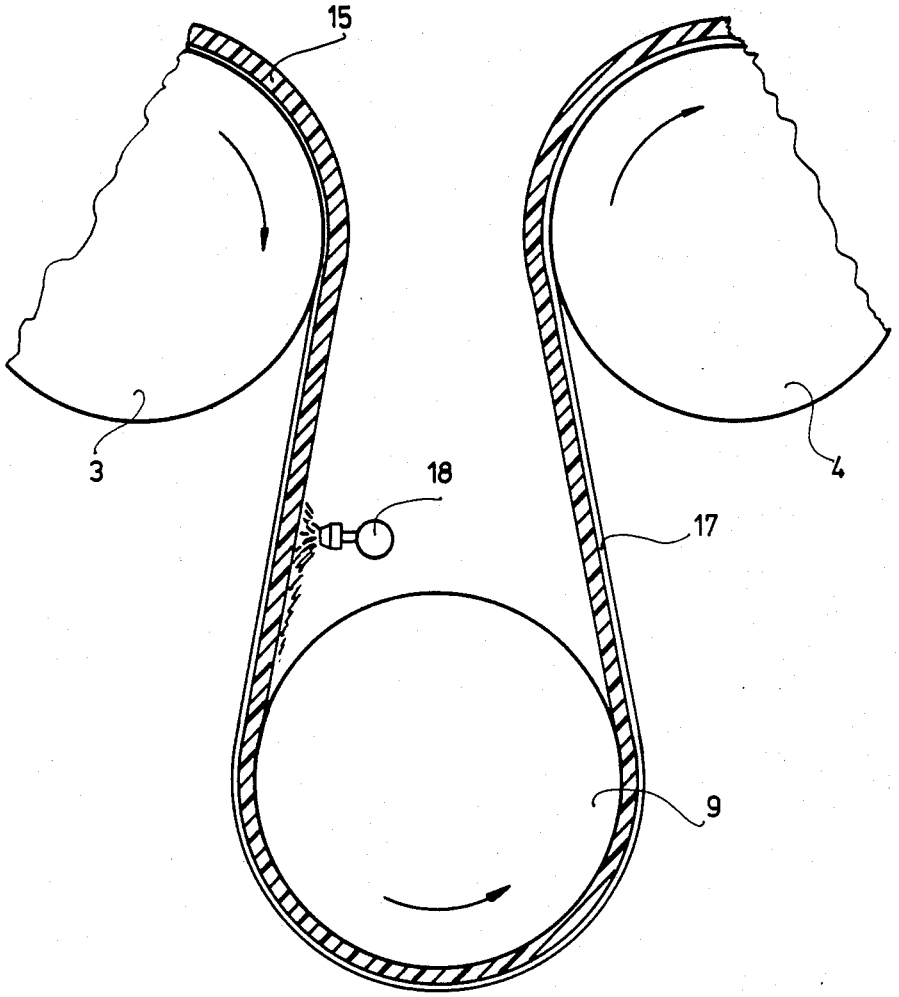
FIG. 2 shows in large scale a part of the drying section in FIG. 1.
Figure 3:
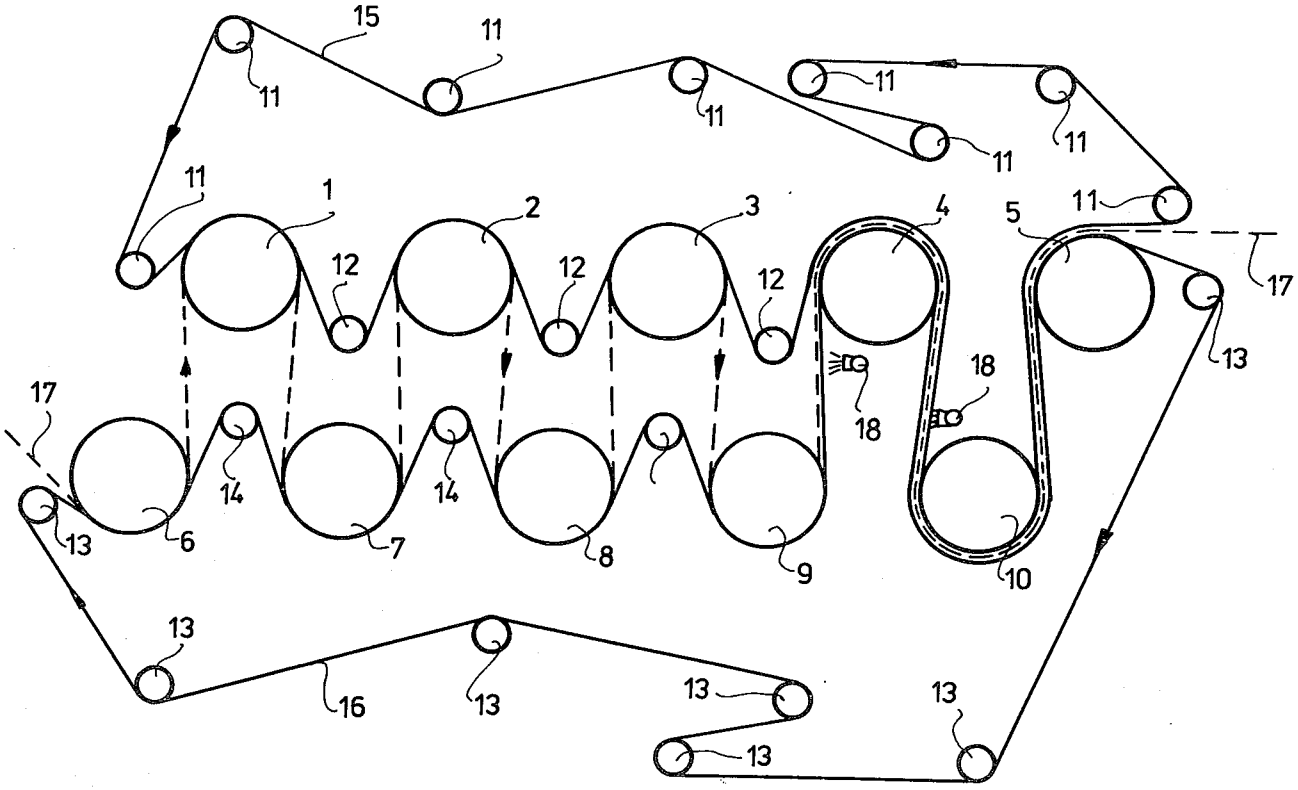
FIG. 3 is a schematic side view of another embodiment of the present invention.

The embodiment of the present invention shown in FIG. 3 is almost the same as the embodiment shown in FIGS. 1 and 2 and in the description of the following embodiments the same parts have the same reference numbers even if the parts have a somewhat different position in the following embodiment than in the embodiment in FIG. 1. In the embodiment of FIG. 3 the cloth 16 leads from drying cylinder 9 together with the fiber web 17 to the drying cylinder 4 where the cloth 15 passes on the outside of the fiber web 17, which is passing on between the cloths 15 and 16 out from the group of drying cylinders. The spraying nozzles 18 are arranged at the drying cylinders 4 and 10. In this embodiment the dampening principal is the same as in the embodiment in FIG. 1.

Figure 4:
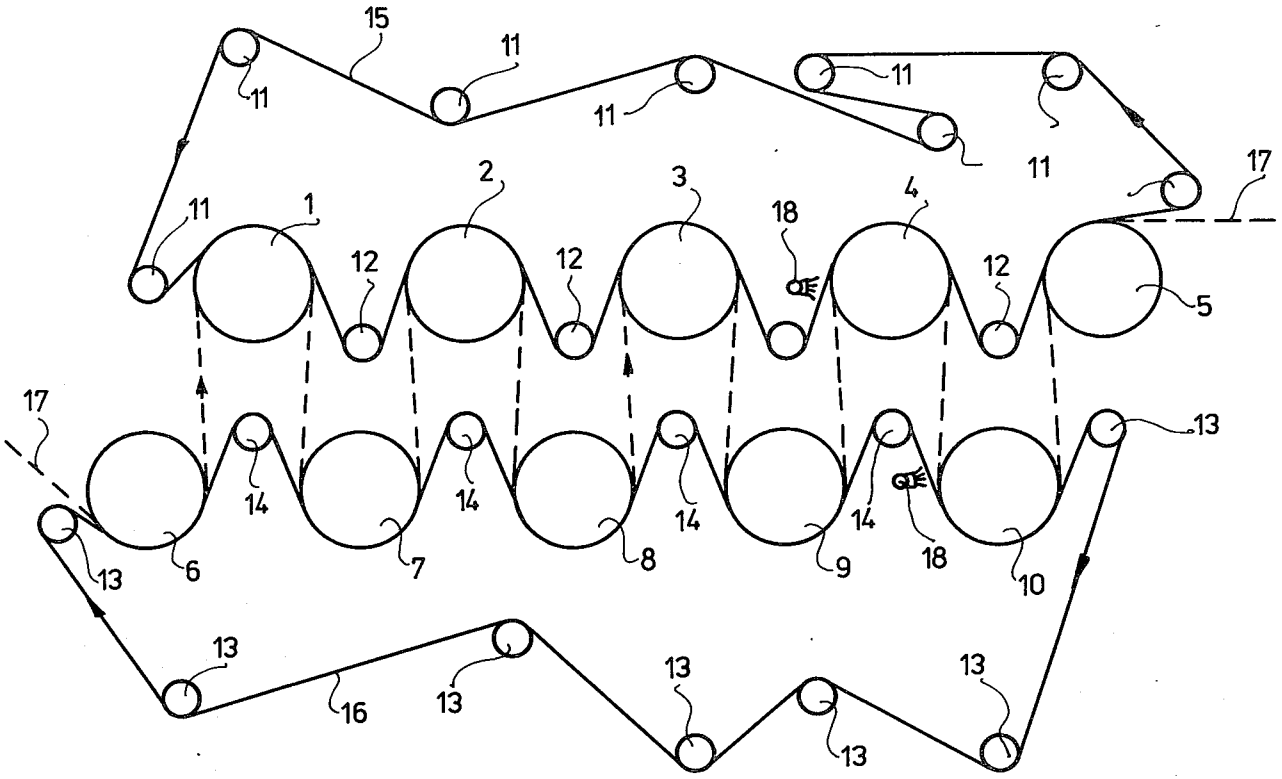
FIG. 4 is a schematic side view of yet another embodiment of the present invention.

In FIG. 4 there is shown an embodiment, wherein the spraying nozzles 18 are arranged between the felt rollers 12 and drying cylinder 4 and between the felt roller 14 and the drying cylinder 10. In this case the cloths 15 and 16 will be moistened or dampened and pass on the outside of the fiber web 17 over the cylinders 4 and 10 respectively. There will be no effective direct transfer of damp or moisture from the outermost cloth to the fiber web 17 in contact with the drying cylinder. Although there will be a certain damp or moisture control of the fiber web 17 or the paper web 17 in that the parts of the cloths 15 and 16 which are damped by the spraying nozzles 18 will prevent moisture loss from the corresponding parts of the fiber web 17, which will lead to a indirect increase of the moisture content of said parts of the fiber web 17.

Figure 5:
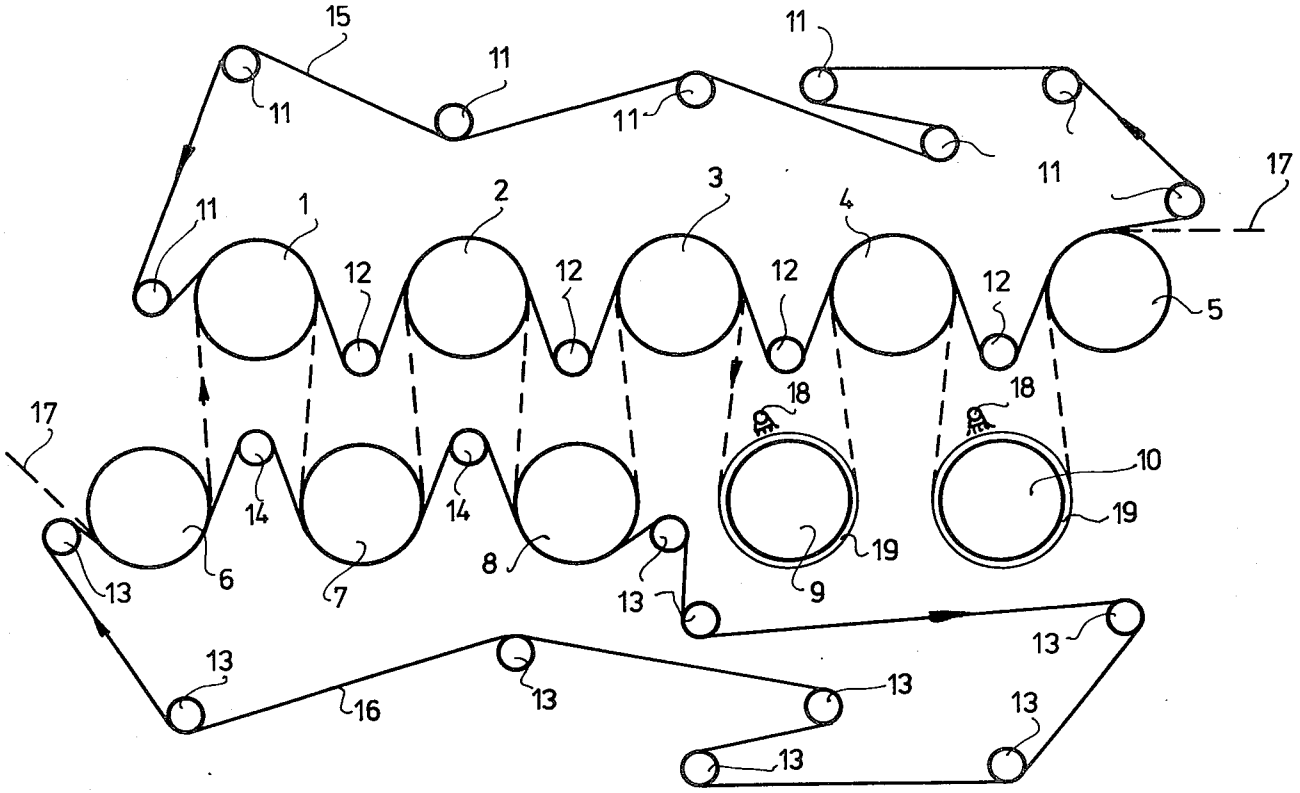
FIG. 5 is a schematic side view of a further embodiment of the present invention.

The embodiment in FIG. 5 has a special cloth 19 arranged on the drying cylinders 9 and 12 by e.g. crimping and the cloth 19 is damped by spraying nozzles 18 before the cloth 19 contacts the fiber web 17. In this embodiment one of the drying cylinders may be eliminated and the spraying means can be arranged inside the cylinders. The principle of moisture control according to this embodiment is the same as the principle of the embodiment in FIG. 1 in that the fiber web 17 passes on the outside of the damped cloth.

Figure 6:
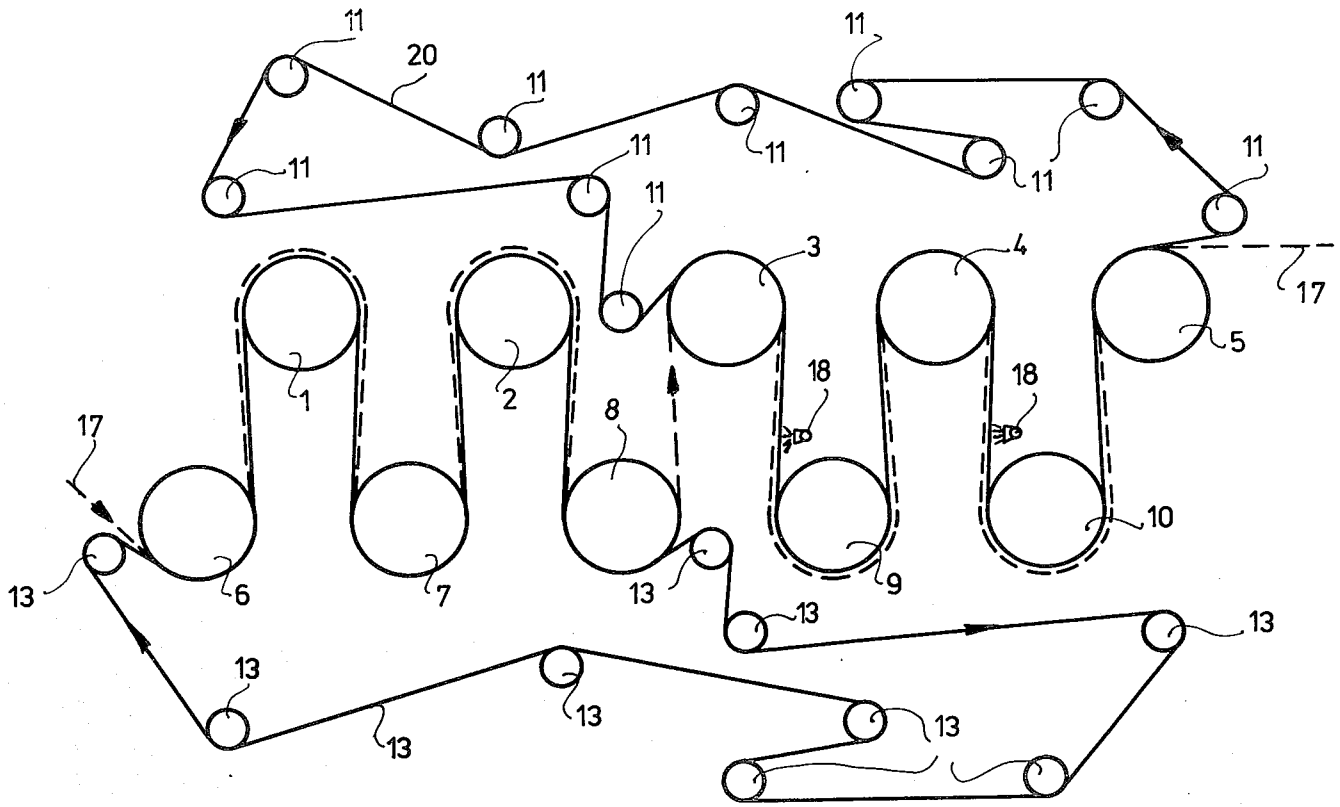
FIG. 6 is a schematic side view of a further embodiment of the present invention.

The embodiment in FIG. 6 has also a special cloth 20 for moisture control, which is passed to contact the fiber web 17 on the drying cylinder 3 and which passes together with the fiber web 17 passed the drying cylinders 9, 4, 10 and 5. In many cases such a special cloth 20 may be more suitable than a common fabric cloth or felt cloth, because the special cloth may be given such special characteristics, which will improve the indirect dampening of the paper web. The cloth 19 on the drying cylinders 9 and 10 of the embodiment in FIG. 5 may also be given such special desired characteristics.

The spraying nozzles 18 or the spraying means of the described embodiments are controllable by a control equipment 18' (FIG. 2) controlled by moisture transmitters also known as moisture sensors 19'. These transmitters 19' are arranged on suitable positions at the fiber web or paper web after a group of drying cylinders equipped with moisture control according to the present invention such as for example in FIG. 1.

Within the scope of the present invention it is naturally possible to use another non-cylindric surface instead of the hot cylinder surfaces.

The embodiments shown on the drawings and described above may be combined with each other within the scope of the claims, e.g. the cloth 16 in FIG. 5 passes around some of or all the rollers 9, 4, 10 and 5, whereby damp or moisture transfer is provided on the same way as in the embodiment in FIG. 3.

Moisture control according to the present invention may also be made in a separate section on the input to a printing press for reaching special moisture characteristics of the paper web to be printed.

The moisture containing means 15, 16, 19 and 20, mentioned above and in the following claims is said to be hygroscopic because of its structure and construction and the material of which it is made. Because of the structure and the construction of the means it has a capillary moisture reception and because of the material choice the means may also have a molecular moisture reception. The means may also have both capillary and moleculary moisture reception. Irrespective the means is capillary and/or moleculary moisture receptive according to the present invention it shall be a at least to a certain part moisture containing hygroscopical means.

What is claimed is:

1. A method for controlling the moisture profile of a fiber web across the width thereof during its movement through a drying section of a paper-making machine, said drying section including drying cylinders carrying a hygroscopic cloth, comprising the steps of:

moisturizing certain zones of the hygroscopic cloth by controlling spraying means located between successive drying cylinders;

controlling said spraying means by transmitters arranged at the fiber web at a position after the web has passed through a group of drying cylinders;

introducing said hygroscopic cloth between said fiber web and one of said drying cylinders, thereby at least partially vaporizing the moisture provided within said cloth in a direction outwardly from said cylinder against said fiber web, the vapor condensing in a part of said fiber web corresponding to said zonewise moisturizing.

2. A method for controlling the moisture content of a fiber web as it passed through the drying section of a paper making machine, said drying section including drying cylinders carrying a hygroscopic cloth, comprising the steps of:

measuring the moisture content of different zones across the width of the fiber web with moisture sensing means;

moisturizing the hygroscopic cloth by moisturizing controlled by said moisture sensing means;

introducing said hygroscopic cloth between said fiber web and one of said drying cylinders contacting said hygroscopic cloth, and heating said drying cylinder such that the moisture within said hygroscopic cloth is at least partially vaporized in a direction towards said fiber web, the vapor condensing in said fiber.

* * * * *